US007784142B2

(12) United States Patent
Scott, Sr.

(10) Patent No.: US 7,784,142 B2
(45) Date of Patent: Aug. 31, 2010

(54) ADJUSTABLE ROLLER FRAME

(75) Inventor: John L. Scott, Sr., Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 606 days.

(21) Appl. No.: 11/852,640

(22) Filed: Sep. 10, 2007

(65) Prior Publication Data

US 2009/0064436 A1 Mar. 12, 2009

(51) Int. Cl.
*B05C 1/08* (2006.01)
*B05C 17/02* (2006.01)

(52) U.S. Cl. ..... 15/230.11; 492/13

(58) Field of Classification Search ..... 15/230.11; 492/13

See application file for complete search history.

(56) References Cited

U.S. PATENT DOCUMENTS 2,702,917 A * 3/1955 Lynden ..... 15/230.11
2,805,436 A 9/1957 Christensen et al.
3,310,831 A 3/1967 Brinker
3,593,361 A 7/1971 Welt
4,077,082 A * 3/1978 Roe et al. ..... 15/230.11
4,868,946 A 9/1989 Marino et al.
7,043,793 B2 5/2006 Lu

* cited by examiner

*Primary Examiner*—Randall Chin
(74) *Attorney, Agent, or Firm*—Renner, Otto, Boisselle & Sklar, LLP

(57) ABSTRACT

Adjustable roller frame includes a pair of housing members having opposed surfaces containing laterally spaced grooves which cooperate to define laterally spaced guideways in which support arms are axially slidably received for supporting roller covers of different lengths and/or diameters between opposite outer end portions of the support arms. These support arms are held in axially adjusted position by one or more cam members movable between a clamping position for applying a friction force to the support arms to hold the support arms against axial movement and a non-clamping position releasing the friction force.

18 Claims, 2 Drawing Sheets

ADJUSTABLE ROLLER FRAME

FIELD OF THE INVENTION

This invention relates to an adjustable roller frame for supporting roller covers of different lengths and/or diameters.

BACKGROUND OF THE INVENTION

It is generally known to provide adjustable roller frames for supporting roller covers of different lengths and/or diameters, for example, from about 9 inches to about 18 inches in length and from about 1½ inches to about 2¼ inches in diameter. Such roller frames may be used to apply paint or other protective coatings or sealers to relatively large flat surfaces such as floors, walls, ceilings, etc.

One such adjustable roller frame that provides for the easy removal and replacement of roller covers of different lengths and diameters is disclosed in U.S. Pat. No. 4,868,946 assigned to the same assignee as the present application. The roller frame disclosed in such patent includes a pair of axially slidable support arms that are frictionally held in the desired axially adjusted position between a body member and a clamp member upon tightening fastener means extending through the body member and clamp member between the support arms. The body member and clamp member have opposed recesses or grooves therein which cooperate to define a pair of laterally spaced generally parallel guideways for sliding receipt of the support arms therein.

SUMMARY OF THE INVENTION

The present invention relates to an adjustable roller frame that uses one or more cam members to create the friction needed to secure the support arms against axial movement.

In accordance with one aspect of the invention, the adjustable roller frame comprises a housing including first and second housing members having opposed surfaces containing laterally spaced grooves which cooperate to define a pair of laterally spaced guideways between the housing members in which a pair of support arms are axially slidably received for supporting roller covers of different lengths and/or diameters between opposite outer end portions of the support arms. These support arms are held in axially adjusted position by cam means movable between a clamping position for applying a friction force to the support arms to hold the support arms against axial movement in the guideways and a non-clamping position to release the friction allowing axial movement of the support arms in the guideways.

In accordance with another aspect of the invention, the cam means may comprise at least one cam pin having one end connected to one of the housing members and another end extending at least partway through the other housing member, and a cam member pivotally connected to the other end of the cam pin, the cam member being engageable with a cam surface on the other housing member during movement of the cam member toward the clamping position to apply a friction force to the support arms.

In accordance with another aspect of the invention, the one end of the cam pin may be threadedly connected to a nut supported by the one housing member, the nut being rotatable relative to the cam pin to allow for compressive force adjustment of the cam member against the cam surface and field assembly and disassembly of various roller frame parts for cleaning, replacement, and/or repair.

In accordance with another aspect of the invention, the nut may be fixedly connected to the one housing member.

In accordance with another aspect of the invention, the opposed surface of each of the housing members may have multiple axially spaced ribs containing the grooves defining the guideways throughout the length of the opposed surface to provide increased surface contact with the support arms, thereby reducing the amount of compressive force of the cam member against the cam surface required to hold the support arms against axial movement when the cam member is in the clamping position.

In accordance with another aspect of the invention, two axially spaced cam means may be located between the guideways and support arms.

In accordance with another aspect of the invention, the materials used for the cam means may be non-metallic, eliminating the potential for corrosion.

These and other aspects, features and advantages of the present invention will become apparent as the following description proceeds.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but several of the various ways in which the principles of the invention may be employed.

BRIEF DESCRIPTION OF THE DRAWINGS

The present invention may be more readily understood by reference to the following drawings in which.

DETAILED DESCRIPTION OF THE INVENTION

Figure 1:
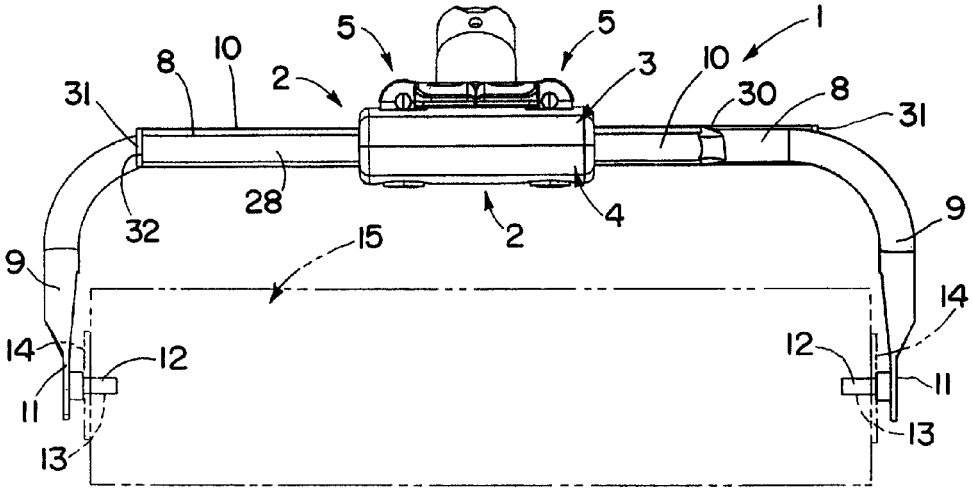
FIG. 1 is a front elevation view of one form of adjustable roller frame according to the present invention.
Figure 2:
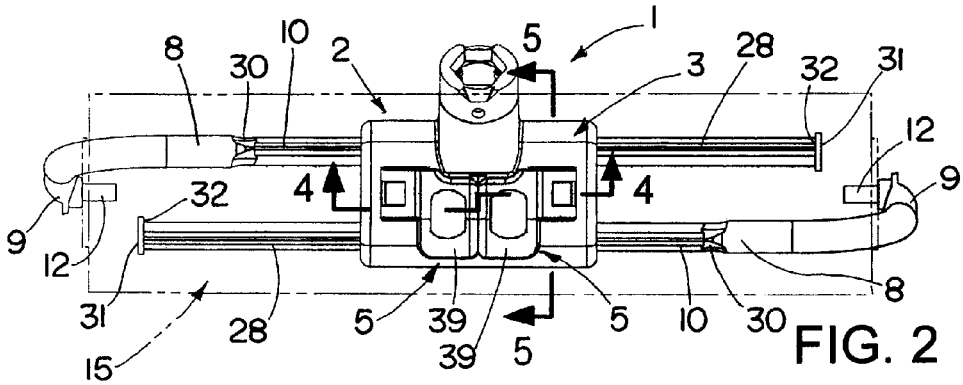
FIG. 2 is a top plan view of the roller frame of FIG. 1.
Figure 3:
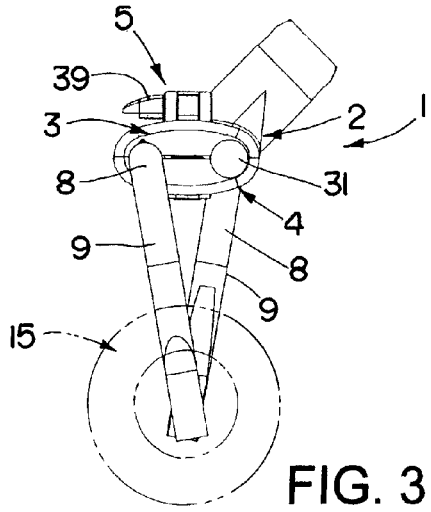
FIG. 3 is an end elevation view of the roller frame of FIG. 1 as seen from the right end thereof.

Referring now in detail to the drawings, wherein the same reference numbers are used to designate like parts, and initially to FIGS. 1-3, there is shown one form of adjustable roller frame 1 of the present invention including a housing 2 comprised of upper and lower housing members 3, 4 and one or more associated cam assemblies 5 for supporting a pair of rod-like support arms 8 for axial sliding movement in opposite directions toward and away from each other. Both support arms 8 may be identical so as to be interchangeable, and are generally L-shaped including a short leg 9 and long leg 10. The short leg 9 may have a relatively flat distal end 11 from which an inwardly facing stub shaft 12 extends for receipt in holes 13 in end caps 14 in the ends of a roller cover 15 shown in phantom lines in FIGS. 1-3.

Figure 4:
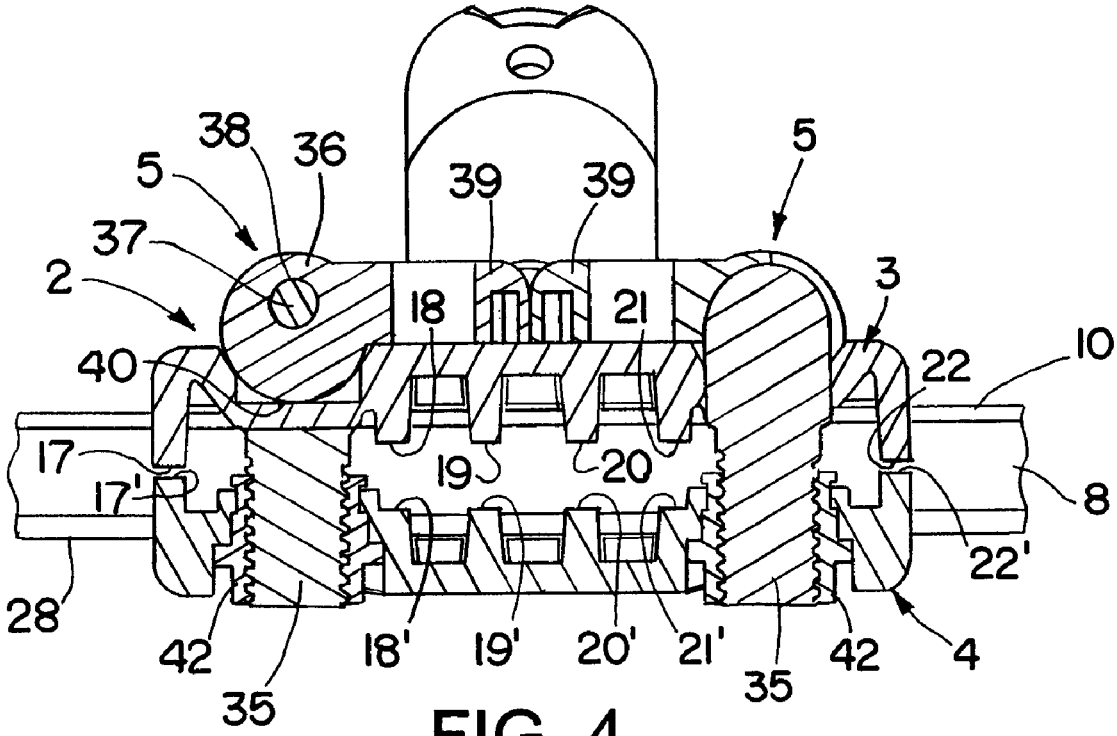
FIG. 4 is an enlarged longitudinal section through the roller frame housing of FIG. 2, taken generally along the plane of the line 4-4 thereof.
Figure 5:
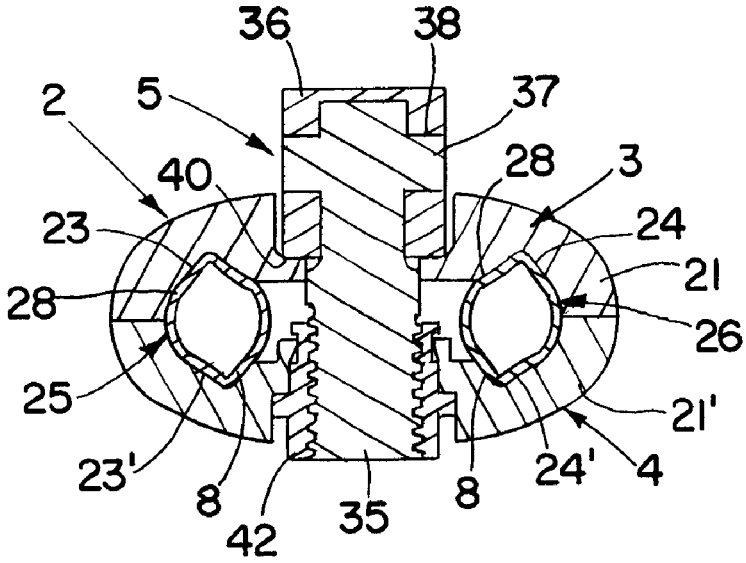
FIG. 5 is an enlarged transverse section through the roller frame housing of FIG. 2, taken generally along the plane of the line 5-5 thereof.

As best seen in FIGS. 4 and 5, housing members 3, 4 include opposed surfaces comprised of multiple axially spaced ribs 17-22 and 17'-22' each containing two laterally spaced grooves 23, 24 and 23', 24' which cooperate to form guideways 25 and 26 therebetween. These guideways have a shape generally corresponding to the cross-sectional shape of non-circular portions 28 of the long legs 10 of support arms 8 to support the support arms against rotation while permitting relative sliding movement of the support arms in opposite directions toward and away from each other for adjusting the longitudinal spacing between the stub shafts 12 for ease of assembly and removal of roller covers 15 of different lengths and/or diameters therebetween.

The grooves 23, 24 and 23', 24' in the ribs 17-22 and 17'-22' in the housing members 3, 4 are substantially parallel to each other, but the lateral spacing between the rib grooves 23', 24' in lower housing member 4 are somewhat closer together which causes a "towing in" of the short legs 9 of the support arms to bring the stub shafts 12 into substantial coaxial alignment with each other for coaxially supporting a roller cover 15 on the stub shafts as shown in FIGS. 2 and 3.

The maximum and minimum spacing between the opposed flattened ends 11 of support arms 8 will be determined by the overall lengths of the non-circular portions 28 of the long legs 10 thereof as well as the lengths of the upper and lower housing members. Axial inner ends 30 of the non-circular portions 28 of long legs 10 of the support arms act as stops limiting axial inward movement of the support arms relative to housing 2. End plugs 31 or the like may be pressed into the distal ends 32 of the long legs 10 of support arms 8 to act as stops limiting axial outward movement of the support arms relative to the housing.

Upper and lower housing members 3, 4 and support arms 8 are maintained in the desired assembled relation by one or more cam assemblies 5. Each cam assembly 5 includes a cam pin member 35 having one end connected to the lower housing member 4 and the other end extending at least partway through the upper housing member 3 and connected to an eccentric cam member 36 as by means of stub shafts 37 extending from one of the members 35, 36 into aligned openings 38 in the other member. Extending outwardly from each cam member 36 is a cam lever 39 for ease of pivoting each cam member between the clamping position shown in FIGS. 4 and 5 in which the cam member 36 engages a cam surface 40 on the upper housing member 3 to apply compressive forces urging the ribs 17-22 and 17'-22' on the housing members into frictional engagement with the support arms to hold the support arms in place and a non-clamping position releasing the compressive forces to permit axial movement of the support arms relative to one another.

Cam pins 35 may be releasably connected to the lower housing member 4 by threadedly connecting the cam pins to nuts 42 fixedly connected to the lower housing member 4. This allows for adjustment of the compressive force of the cam members 36 acting on the cam surfaces 40 during movement of the cam members to the clamping position by rotating the nuts 42 relative to the cam pins and permits field assembly and disassembly of the roller frame parts for cleaning, replacement and/or repair.

From the foregoing, it will be apparent that the adjustable roller frame of the present invention is of a unique design that provides for easy removal and replacement of roller covers of different lengths and/or diameters by operation of one or more cam members which cannot easily be taken off and lost or stolen. Yet the nut connections between the cam pins and one of the housing members allow for clamp tension adjustment and field assembly and disassembly of the component parts of the adjustable roller frame for cleaning, replacement and/or repair.

Moreover, providing multiple axially spaced ribs throughout the length of opposing surfaces of the housing members containing the grooves that cooperate to form the guideways for the support arms increase the surface contact with the support arms, greatly reducing the clamping force required to hold the support arms in proper adjustment. Also, the various components of the adjustable roller frame including particularly the housing, cam pins, cam members and nuts may be made of suitable plastic materials, eliminating the potential for corrosion.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiment of the invention. In addition, while a particular feature of the invention may have been disclosed with respect to only one embodiment, such feature may be combined with one or more other features as may be desired and advantageous for any given or particular application.

What is claimed is:

1. An adjustable roller frame comprising first and second housing members having opposed surfaces containing laterally spaced grooves which cooperate to define a pair of laterally spaced guideways between the housing members, a pair of support arms axially slidably received in the guideways, the support arms having opposite outer ends for supporting a roller cover therebetween, and cam means movable between a clamping position for applying a friction force to the support arms to hold the support arms against axial movement in the guideways and a non-clamping position to release the friction force allowing axial movement of the support arms in the guideways.

2. The roller frame of claim 1 wherein the cam means comprises at least one cam pin having one end connected to one of the housing members and another end extending at least partway through the other housing member, and a cam member pivotally connected to the other end of the cam pin, the cam member being engageable with a cam surface on the other housing member during movement of the cam member toward the clamping position to apply a friction force to the support arms.

3. The roller frame of claim 2 wherein the one end of the cam pin is threadedly connected to a nut supported by the one housing member, the nut being rotatable relative to the cam pin to allow for compressive force adjustment of the cam member against the cam surface and field assembly and disassembly of various roller frame parts for cleaning, replacement and/or repair.

4. The roller frame of claim 3 wherein the nut is fixedly connected to the one housing member.

5. The roller frame of claim 1 wherein the cam means is located between the guideways and the support arms.

6. The roller frame of claim 5 wherein there are two axially spaced cam means located between the guideways and the support arms.

7. The roller frame of claim 1 wherein the support arms are generally L-shape including a first leg axially slidably received in the guideways and a second leg extending generally at right angles to the first leg, the support arms facing in opposite directions in the guideways and being movable in opposite directions to move the second legs toward and away from each other when the cam means is in the non-clamping position to vary the spacing between the second legs for removably mounting a roller cover between the second legs.

8. The roller frame of claim 7 wherein the guideways are non-circular in shape, and the first leg of each support arm has a corresponding non-circular shape over a portion of its length which is received in the guideways to prevent relative rotational movement of the support arms in the guideways while permitting relative axial sliding movement therebetween when the cam means is in the non-clamping position.

9. The roller frame of claim 8 wherein there is a first stop at an axial inner end of the non-circular portion of the first leg of each of the support arms limiting axial inward movement of the support arms relative to the housing members, and a second stop at or adjacent an axial outer end of each of the support arms limiting axial outward movement of the support arms relative to the housing members.

10. The roller frame assembly of claim 2 wherein the opposed surface of each of the housing members has at least three axially spaced ribs containing grooves defining the guideways in which the support arms are slidably received to reduce the amount of compressive force of the cam member against the cam surface required to hold the support arms against axial movement when the cam member is in the clamping position.

11. The roller frame of claim 10 wherein there are multiple axially spaced ribs containing grooves defining the guideways in which the support arms are slidably received throughout the length of the opposed surfaces of the housing members.

12. The roller frame of claim 3 wherein a cam lever extends outwardly from the cam member to facilitate movement of the cam member between the clamping and unclamping positions.

13. The roller frame member of claim 3 wherein the cam member, cam pin and nut are made of plastic.

14. An adjustable roller frame comprising first and second housing members each having opposed surfaces containing laterally spaced grooves defining a pair of laterally spaced guideways between the housing members, a pair of support arms axially slidably received in the guideways, the support arms having opposite outer ends for supporting a roller cover therebetween, at least one cam pin having one end connected to one of the housing members and another end extending at least partway through the other housing member, and an eccentric cam member pivotally connected to the other end of the cam pin, the cam member being engageable with a cam surface on the other housing member during pivoting of the cam member between a clamping position for applying a friction force to the support arms to hold the support arms against axial movement relative to one another and a non-clamping position to release the friction force allowing axial movement of the support arms relative to one another.

15. The roller frame of claim 14 wherein the one end of the cam pin is connected to a nut supported by the one housing member, the nut being rotatable relative to the cam pin to allow for compressive force adjustment of the cam member against the cam surface when the cam member is in the clamping position and field assembly and disassembly of various roller frame parts for cleaning, replacement and/or repair.

16. The roller frame of claim 15 wherein the nut is fixedly connected to the one housing member.

17. The roller frame of claim 14 wherein there are multiple axially spaced ribs containing grooves defining the guideways in which the support arms are slidably received throughout the length of the opposed surfaces of the housing members to reduce the amount of compressive force of the cam member against the cam surface required to hold the support arms against axial movement when the cam member is in the clamping position.

18. The roller frame of claim 14 wherein there are two axially spaced apart cam pins and associated cam members located between the guideways and the support arms.

* * * * *